US008544996B2

(12) United States Patent
Hays et al.

(10) Patent No.: US 8,544,996 B2
(45) Date of Patent: Oct. 1, 2013

(54) ROCK SCREEN WITH PARTICLE TRAP

(75) Inventors: Andrew W Hays, Fairport, NY (US); Terrance L Stephens, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/355,921

(22) Filed: Jan. 23, 2012

(65) Prior Publication Data

US 2013/0187981 A1 Jul. 25, 2013

(51) Int. Cl.
*B41J 2/165* (2006.01)

(52) U.S. Cl.
USPC ..... 347/93

(58) Field of Classification Search
None
See application file for complete search history.

(56) References Cited

U.S. PATENT DOCUMENTS

| | | | | |
|---|---|---|---|---|
| 5,030,972 | A | 7/1991 | Miyazawa et al. | |
| 2010/0045738 | A1 * | 2/2010 | Stephens et al. | 347/44 |
| 2011/0141204 | A1 | 6/2011 | Dolan et al. | |
| 2011/0254895 | A1 * | 10/2011 | Yokouchi | 347/31 |

* cited by examiner

*Primary Examiner* — Matthew Luu
*Assistant Examiner* — Alejandro Valencia

(57) ABSTRACT

The possibility that narrow, high aspect ratio particles will pass through a rock screen of a print head is reduced by minimizing the number of times the particles interact with the rock screen. Each interaction is an opportunity for the particle to be positioned in an orientation such that it may pass through the rock screen. The reduction in particles passing through the rock screen is achieved by positioning a particle trap adjacent to the rock screen perimeter to collect debris that sloughs off the rock screen.

6 Claims, 2 Drawing Sheets

ROCK SCREEN WITH PARTICLE TRAP

BACKGROUND

1. Field of the Disclosure

The present disclosure relates to an ink jet recording apparatus and method in which ink droplets are jetted to form images on a recording media, such as, recording sheets, and more particularly, to an ink jet recording apparatus print head that includes a trap positioned within an ink sump and in close proximity to a rock screen to capture particles that slough off the screen.

2. Description of Related Art

Ink jet printers are a well known and widely used form of printed media production. Colorants, usually ink, are fed to an array of micro-processor controlled nozzles on a print head. As the print head passes over the media, colorant is ejected from the array of nozzles to produce the printing on the media substrate.

Computers, fax machines, plotters and printers have presented a growing demand for high quality reproduction and print quality on different recording medium. This demand has necessitated the efficient supply of contamination free ink to recording apparatuses and the development of better means of transferring ink to a recording medium. An example of an ink jet recording apparatus that employs solid-phase ink that is heated to melt and fed into a print head is shown in U.S. Pat. No. 5,030,972. One method of assembling a print head is disclosed in U.S. Patent Application Publication No. US 2011/0141204 A1, now U.S. Pat. No. 8,303,093.

Current solid ink print heads utilize a rock screen to protect jets from contamination. The rock screen is generally effective at stopping particles whose smallest dimension exceeds the pore size of the rock screen holes. However, high aspect ratio particles that are narrow enough to pass through the rock screen can re-orient in the flow to potentially block a downstream aperture causing print quality defects. Additionally, the majority of debris that is stopped by the rock screen sloughs off and is delivered to the rock screen in a new orientation during subsequent flow cycles (printing or purging). This increases the opportunity for a given particle to orient in such a way that it can pass through the rock screen into the jet and cause print quality defects.

Hence, there is still a need for a print head that can eject contamination free ink and thereby improve the quality of printed images.

BRIEF SUMMARY

In answer to this need, provided hereinafter is a method and apparatus that reduces the possibility that narrow, high aspect ratio particles pass through the rock screen by minimizing the number of times the particles interact with the screen. Each interaction is an opportunity for the particle to be positioned in an orientation such that it may pass through the rock screen. Particle traps with "dead zones" are placed adjacent to the rock screen perimeter to collect debris that sloughs off the rock screen. The "dead zones" are sufficiently deep to prevent particles from experiencing flow velocities that would subsequently re-entrain the particles into the main flow and back to the rock screen.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some such components are known per se' in other apparatus or applications, which may be additionally or alternatively used herein, including those from art cited herein. The cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
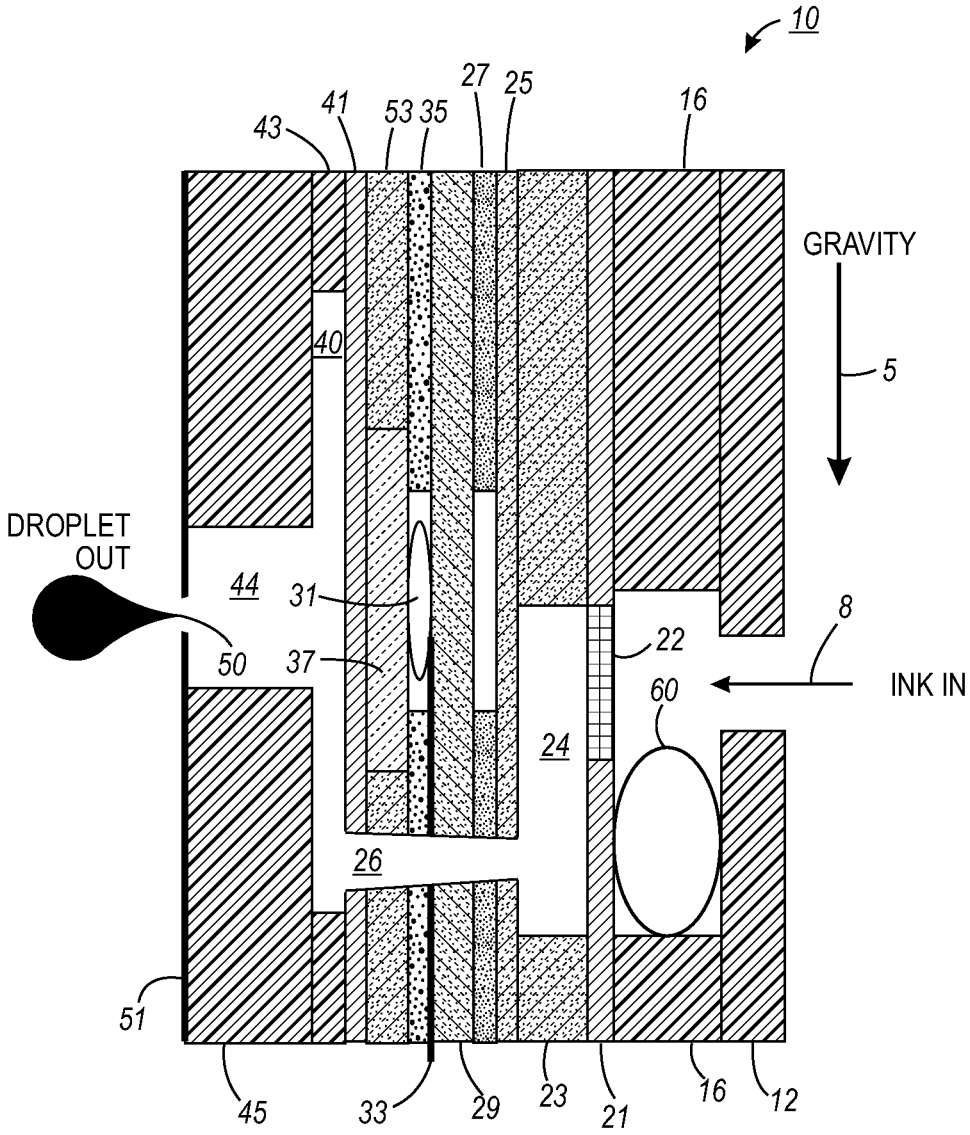
FIG. 1 is a partial, profile view of an exemplary ink jet print head that includes the rock screen particle traps of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to preferred ink jet print head embodiments that include a method and apparatus for removing debris that sloughs off a rock screen.

For a general understanding of the features of the disclosure, reference is made to the drawings. In the drawings, like reference numerals have been used throughout to identify identical elements.

Referring now to FIG. 1, a print head 10 is shown that includes the improved method and apparatus for removing contamination from inks exiting the print head for improved image quality.

In FIG. 1, a print head 10 is shown that includes an aperture plate 51 having an outlet plate 45 where outlet plate 45 is attached to the aperture plate by a suitable adhesive. Ink flows into print head 10 in the direction of arrow 8 through manifold 12 and then into manifold 16 with the manifolds acting as reservoirs supplying ink to downstream pressure chambers 40 and 44, and each pressure chamber has a dedicated ink inlet connected to the manifold. A layer 21 contains a rock screen 22 formed by an array of small holes, for example laser micro drilled holes in polyimide. Rock screen 22 is in ink flow communication with reservoir 24 formed by layer 21 with rock screen 22 formed therein, manifold 23, and a flexible spacer polyimide 25 attached to the bottom of manifold 23 with a standoff layer 27 attached to flexible spacer 25 and to a flexible polyimide circuit 29. Flexible circuit polyimide 29 and electrically conductive traces 33 along with piezoelectric transducer layer 37 positioned between standoff member 35 form an electrical connection by means of, for example, electrically conductive epoxy 31. Interstitial fill 53 surrounds the piezoelectric transducer layer 37. A diaphragm 41 is positioned underneath the piezoelectric transducer layer 37 with diaphragm adhesive connected thereto and positioned on top of body plate 43 which is suitably bonded to outlet plate 45 to form pressure chambers 40 and 44. Outlet plate 45 is bonded to aperture plate 51. An ink inlet 26 facilitates the passage of ink from reservoir 24 into pressure chambers 40 and 44.

A majority of the debris passing into manifolds 12 and 16 and forced against rock screen 22 during ink flow drops off once the flow is stopped. It typically, due to gravity represented by arrow 5, drops straight down along the surface of the rock screen until it comes to rest on the floor. It is at this location the present disclosure can be implemented.

In accordance with the present disclosure, a particle trapping area 60 is included in print head 10 of FIG. 1 to reduce the possibility that narrow, high aspect ratio particles pass through the rock screen by minimizing the number of times the particles interact with the screen. Each interaction is an opportunity for a particle to be positioned in an orientation such that it may pass through the rock screen. A particle trap formed by manifold 12 and manifold or trapping layer 16 is positioned adjacent to the perimeter of rock screen 22 to collect debris that sloughs off the rock screen. Non-neutrally buoyant particles will move to the traps under the influence of gravity. Once the flow stops, particles will move under the influence of gravity provided they are at a different density from the ink. These particles will move to the trapping areas where subsequent flow is incapable of dislodging them. The "dead zones" of the trap are sufficiently deep to prevent the particles from experiencing flow velocities that would subsequently re-entrain the particles into the main flow and back to the rock screen. It is contemplated that particles in the ink which are density light particles will migrate upward to debris collection areas in the top portion of manifold 16 on the perimeter of rock screen 22. External forces such as a momentary back flow can also be used to encourage debris sloughing.

The thickness of the trapping layer 16 is dependent on the kind of contamination that is being trapped. Oblong chunks of material may only require a thickness of 0.002", but particles that have a more fibrous morphology would require something thicker in order for the particle to be able to fall into the trap. Likewise, the depth of the trap will depend on the particle geometry and the flow rates during printing and purging. The trapping area 60 preferably has a particle gap of about 75 μm for the collection of sloughed debris.

Alternatively, an external force may be applied to encourage sloughing of the particles. A small negative pressure pulse on the ink supply would cause a momentary back flow through the rock screen that could force particles off the rock screen. Sub-threshold jetting to provide an acoustic vibration can also be effective though this would depend a lot on the type of particles. Finally, the act of freezing the ink and thawing the ink tends to deform the rock screen in the direction of the ink supply. As the ink thaws the rock screen will return to its normal flat configuration and ink will be forced through the holes dislodging particles. Freeze/thaw with delamination of the frozen ink from the rock screen would also provide a significant force on particles to remove them from the rock screen, but whether or not the ink delaminates from the rock screen depends on the geometry and engineering of the print head.

Figure 2:
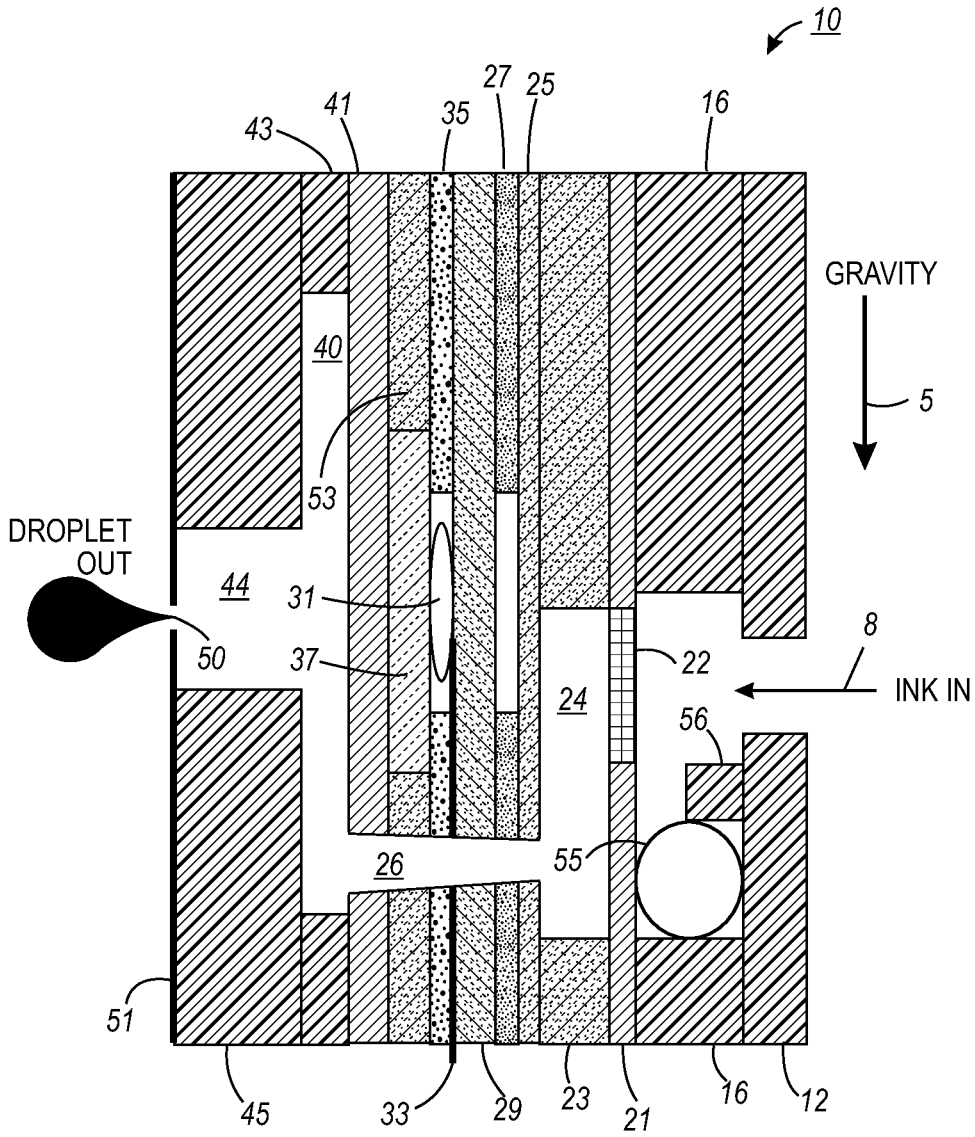
FIG. 2 is partial profile view of the exemplary ink jet print head of FIG. 1 that includes a second embodiment of the rock screen particle traps in accordance with the present disclosure.

In FIG. 2, another embodiment of the present disclosure is shown that is identical to the print head 10 except for a different configuration of particle trap or cavity 55. Particle trap 55 is formed between manifold 16, member 56 which is a part of manifold 16, rock screen 22 and manifold 12, preferably forming a debris receptive gap of about 25 μm.

In operation, ink flows from manifold 12 into manifold 16 and then through rock screen 22 into reservoir 24. Ink then flows through inlet 26 into pressure chambers 40 and 44. An electrical firing signal sent to the piezoelectric transducer 37 via electrical traces 33 and conducting epoxy 31 or, other means of producing the electrical connection, causes the piezoelectric transducer to bend, deforming diaphragm 41 into pressure chamber 40. This deforming urges ink out of pressure chamber 40 into pressure chamber 44 and through nozzle 50 where the ink exits the print head as a droplet. After the ink droplet is ejected, the chambers are refilled with ink supplied from the manifolds with the piezoelectric transducer aiding the process by deforming in the opposite direction to cause concomitant movement of the diaphragm and polymer layers that draw ink from the manifolds into the pressure chambers.

In recapitulation, a print head is disclosed that reduces the possibility that narrow, high aspect ratio particles in ink flowing through the print head will pass through a rock screen positioned within the ink flow by including a particle trap placed adjacent to the rock screen perimeter to collect debris that sloughs off the rock screen during ink flow through the print head.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An ink jet print head configured to remove debris from ink flowing threrethrough, comprising:

a manifold for receiving ink therein;

a rock screen positioned with respect to said manifold to receive said ink and allow passage of said ink threrethrough;

a reservoir positioned to receive said ink passing through said rock screen;

a pressure chamber for receiving said ink from said reservoir;

an inlet adapted for passage of said ink from said reservoir to said pressure chamber;

an aperture nozzle;

a piezoelectric transducer adapted to force ink from said pressure chamber in droplet form out of said aperture nozzle; and a trap portion configured as part of said manifold and adapted to collect debris from said ink that contacts said rock screen and sloughs off said rock screen and drops due to gravity into said trap portion, said trap portion being further configured such that subsequent flow of ink toward said rock screen is incapable of dislodging the debris from said trap portion, and wherein said trap portion includes a U-shaped portion with a bottom portion thereof that is positioned below a bottom portion of said rock screen to such an extent that it prevents the debris collected therein from experiencing flow velocities that would subsequently re-entrain the debris into the main flow and back to said rock screen.

2. The print head of claim 1, wherein said trap portion includes a section of said manifold that has top and bottom portions that form a gap for debris collection of about 25 μm.

3. The print head of claim 1, including first and second manifolds positioned for the passage of said ink therethrough upstream of said rock screen.

4. The print head of claim 3, wherein said trap portion includes portions of said second manifold.

5. The print head of claim 4, including a second pressure chamber.

6. The print head of claim 1, including multiple pressure chambers.

* * * * *